US011846138B2

(12) United States Patent
Zhu et al.

(10) Patent No.: US 11,846,138 B2
(45) Date of Patent: Dec. 19, 2023

(54) HYDRAULIC OSCILLATION TOOL WITH VARIABLE STAGE, SMALL PRESSURE DROP AND STRONG IMPACT BASED ON RADIO FREQUENCY IDENTIFICATION

(71) Applicant: Southwest Petroleum University, Chengdu (CN)

(72) Inventors: Xiaohua Zhu, Chengdu (CN); Changshuai Shi, Chengdu (CN); Feilong Cheng, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 17/993,909

(22) Filed: Nov. 24, 2022

(65) Prior Publication Data

US 2023/0184038 A1 Jun. 15, 2023

(30) Foreign Application Priority Data

Dec. 15, 2021 (CN) ..... 202111539733.9

(51) Int. Cl.

| | |
|---|---|
| ***E21B 4/14*** | (2006.01) |
| ***E21B 31/00*** | (2006.01) |
| ***E21B 7/24*** | (2006.01) |

(52) U.S. Cl.

CPC ..... *E21B 4/14* (2013.01); *E21B 7/24* (2013.01); *E21B 31/005* (2013.01); *E21B 2200/01* (2020.05)

(58) Field of Classification Search

CPC . E21B 4/14; E21B 7/24; E21B 31/005; E21B 2200/01

See application file for complete search history.

(56) References Cited

U.S. PATENT DOCUMENTS

| | | | | |
|---|---|---|---|---|
| 9,995,113 | B2 * | 6/2018 | Garcia | E21B 47/13 |
| 10,677,006 | B2 * | 6/2020 | von Gynz-Rekowski | E21B 31/005 |
| 2012/0067594 | A1 * | 3/2012 | Noske | E21B 47/138 166/373 |
| 2020/0173255 | A1 * | 6/2020 | Akkerman | E21B 34/10 |
| 2020/0399974 | A1 * | 12/2020 | Papadimitriou | E21B 21/08 |
| 2021/0047899 | A1 * | 2/2021 | Docherty | E21B 34/08 |

* cited by examiner

*Primary Examiner* — Yong-Suk (Philip) Ro

(74) *Attorney, Agent, or Firm* — Zhigang Ma

(57) ABSTRACT

A hydraulic oscillation tool with variable stage, small pressure drop and strong impact based on radio frequency identification is provided. It includes a conversion connector, a disc spring upper bracket, a disc spring housing, a disc spring group, a multi-stage piston shaft, an upper piston sleeve, a first radial sealing ring, a double-female-buckle piston sleeve, a double-male-buckle piston sleeve, a second radial sealing ring, a double-female-buckle lower piston sleeve, an end piston, an impacting connector, a power housing, a power shaft end cap, a high torque turbine, a power shaft, a lower connector, a rotating valve, a bearing supporting ring, and a turbine special bearing. The hydraulic oscillation tool realizes the low pressure drop and strong impact, and thus the problems that with the continuous increase of horizontal length, excessive pressure drop will make the annular pressure drop sharply, and drilling fluid circulation is difficult are solved.

7 Claims, 5 Drawing Sheets

HYDRAULIC OSCILLATION TOOL WITH VARIABLE STAGE, SMALL PRESSURE DROP AND STRONG IMPACT BASED ON RADIO FREQUENCY IDENTIFICATION

TECHNICAL FIELD

The disclosure relates to the field of oil and gas exploitation technologies, and more particularly to a hydraulic oscillation tool with variable stage, small pressure drop and strong impact based on radio frequency identification.

BACKGROUND

With the increase of drilling depth and the decrease of formation drillability, it is difficult to avoid difficulties such as pressure release and sticking often occurring in horizontal well sections. At present, the solution is to install an impact tool immediately behind a power drilling tool, and the greater the pressure drop, the greater the impact force. However, with the continuous increase of the horizontal length, excessive pressure drop will make an annular pressure drop be sharply reduced, and the drilling fluid circulation is difficult. Therefore, it is urgent to use a tool with small pressure drop but strong impact to reduce the pressure loss.

In view of the above problems, a hydraulic oscillation tool with variable stage, small pressure drop and strong impact based on radio frequency identification is proposed in the disclosure. The tool uses a high torque turbine as a power source, and uses multi-stage pressure cavities to increase the area to achieve a purpose of low pressure drop and strong impact. It solves the problem of insufficient impact and excessive pressure drop in the long horizontal section, saving a lot of time, manpower, material, and financial resources.

SUMMARY

A purpose of the disclosure is to solve the problems that with the continuous increase of horizontal length, the impact force is continuously increased, an annular pressure drop is sharply reduced due to excessive pressure drop, drilling fluid circulation is difficult, and an oscillation tool with small pressure drop and strong impact is urgently needed. In this situation, a hydraulic oscillation tool with variable stage, small pressure drop and strong impact based on radio frequency identification is designed, so that the oscillation tool with low pressure drop and strong impact is realized.

In order to achieve the above purpose, the technical solutions employed by the disclosure to solve the problems are as follows. Specifically, the hydraulic oscillation tool with variable stage, small pressure drop and strong impact based on radio frequency identification, including a conversion connector, an upper bracket (also referred to as a disc spring upper bracket), a disc spring housing, a disc spring group, a multi-stage piston shaft, an upper piston sleeve, a first radial sealing ring, a double-female-buckle piston sleeve (also referred to as a piston sleeve with double female buckles), a double-male-buckle piston sleeve (also referred to as a piston sleeve with double male buckles), a second radial sealing ring, a double-female-buckle lower piston sleeve (also referred to as a lower piston sleeve with double female buckles), an end piston, an impacting connector, a power housing, a power shaft end cap, a high torque turbine, a power shaft, a lower connector, a rotating valve, a bearing-supporting ring, a turbine-fitting bearing, a first O-ring, a second O-ring, a third O-ring, a fourth O-ring.

The conversion connector is connected to the multi-stage piston shaft through tapered threads; the disc spring housing is connected to the upper bracket and the upper piston sleeve through tapered threads; the disc spring group is disposed between the disc spring housing and the conversion connector; the double-female-buckle piston sleeve is connected to the upper piston sleeve and the double-male-buckle piston sleeve through tapered threads; the double-female-buckle lower piston sleeve is connected to the impacting connector and the double-male-buckle piston sleeve through tapered threads; the end piston is connected to the multi-stage piston shaft through threads, and the first O-ring is disposed between the end piston and the impacting connector.

A ground pressure pump pressurizes a wellbore, a drilling fluid drives the high torque turbine passing through an inner cavity of the conversion connector and an inner cavity of the multi-stage piston shaft. Under the action of the drilling fluid, the high torque turbine drives the power shaft to rotate, and in this situation, the rotating valve connected to the power shaft and an inner hole of the lower connector realize relative rotary movement, thus realizing the alternation of drilling fluid flow areas. When the flow area decreases, a pressure in a cavity of the tool increases, when the flow area increases, the pressure in the cavity of the tool decreases, so that the pressure in the cavity of the tool increases and decreases alternately. When the pressure in the cavity of the tool increases, the drilling fluid acts on the end piston, under the action of the pressure of the drilling fluid, the multi-stage piston shaft compresses the disc spring group to convert the pressure of the drilling fluid into mechanical energy and then into elastic potential energy of the disc spring group. When the pressure in the cavity decreases, the elastic potential energy of the disc spring group is released, and the elastic potential energy is converted into the mechanical energy, and the tool generates an impact.

A soluble small ball with a radio-frequency identification (RFID) tag is input and pumped into the tool. When the soluble ball passes through the second radial sealing ring, the second radial sealing ring moves axially, in this situation, a first hole on the multi-stage piston shaft corresponding the second radial sealing ring is opened, the drilling fluid enters a cavity between the multi-stage piston shaft and the double-male-buckle piston sleeve, and thus the pressure action area is increased and the impact force of the tool is also increased. Another soluble ball with another RFID tag is input and pumped into the tool, the hole on the multi-stage piston shaft corresponding to the first radial sealing ring is opened, to further increase the pressure area and further increase the impact force of the tool.

In some embodiments, a number of torque turbines is in a range of 1 to 3, and the torque turbines are disposed in a same direction. The number of torque turbines and the pressure of drilling fluid determines a rotational speed of the power shaft 17, thereby affecting the tool frequency.

In some embodiments, a number of stages of the multi-stage piston shaft is in a range of 2 to 4, and a number of the first radial sealing ring and the second radial sealing ring is in a range of 2 to 4. The more stages, the same impact force can be achieved under the smaller pressure drop of the tool, especially for long horizontal sections.

In some embodiments, the third O-ring is disposed among the second radial sealing ring, the first radial sealing ring and the multi-stage piston shaft.

In some embodiments, when the soluble balls with the RFID tags are put into use to make a pump pressure be controlled to change without changing the impact force or the pump pressure be kept unchanged to enhance the impact force.

In some embodiments, the soluble balls with the RFID tags are dissolved in place and backflow after the radio frequency signal identification.

In some embodiments, the second radial sealing ring and the first radial sealing ring each are disposed with a RFID signal-receiving device for receiving a radio frequency signal of the soluble ball with the RFID tag.

It can be seen from the above technical solutions provided by the disclosure that, compared with the prior art, the disclosure provides the hydraulic oscillation tool with variable stage, small pressure drop and strong impact based on radio frequency identification, which has a simple main structure, can be opened intelligently, controls the impact force, and can simply open and close the tool. The disclosure uses non-contact radio frequency identification technology, which has stable signal and high precision. The disclosure has the advantages of convenient operation, safety, reliability, strong adaptability, and small impact on a lower drilling tool. The disclosure can solve the problems of insufficient impact in the long horizontal section and excessive pressure drop, thereby saving a lot of time, manpower, material resources and financial resources.

Figure 1:
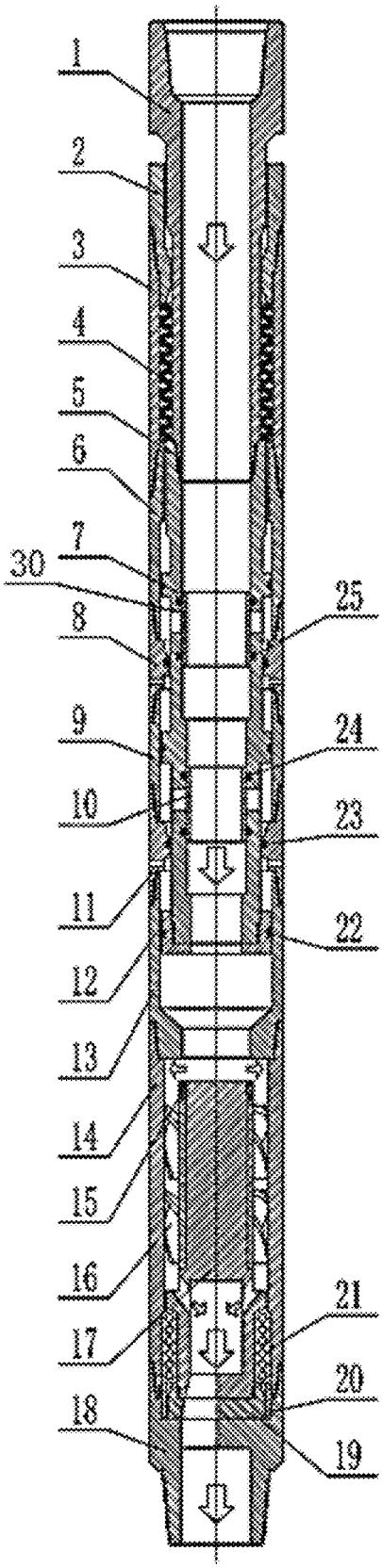
FIG. 1 is a schematic diagram of an initial state of a hydraulic oscillation tool of the disclosure.

Description of reference signs: 1: conversion connector, 2: upper bracket (also referred to as disc spring upper bracket), 3: disc spring housing, 4: disc spring group, 5: multi-stage piston shaft, 6: upper piston sleeve, 7: first radial sealing ring (also referred to as radical sealing ring B), 8: double-female-buckle piston sleeve (also referred to as piston sleeve with double female buckles), 9: double-male-buckle piston sleeve (also referred to as piston sleeve with double male buckles), 10: second radial sealing ring (also referred to as radial sealing ring A), 11: double-female-buckle lower piston sleeve (also referred to as lower piston sleeve with double female buckles), 12: end piston, 13: impacting connector, 14: power housing, 15: power shaft end cap, 16: high torque turbine, 17: power shaft, 18: lower connector, 19: rotating valve, 20: bearing-supporting ring, 21: turbine-fitting bearing, 22: first O-ring (also referred to as O-ring A), 23: second O-ring (also referred to as O-ring B), 24: third O-ring (also referred to as O-ring C), 25: fourth O-ring 25 (also referred to as O-ring D), 26: drill string, 27: oscillation tool, 28: drilling bit, O: first hole, O': second hole, 30: RFID signal-receiving device.

DETAILED DESCRIPTION OF EMBODIMENTS

In order to have a clearer understanding of technical features, purposes, and effects of the disclosure, specific embodiments of the disclosure are described with reference to the accompanying drawings.

The specific embodiments of the disclosure described herein are only used to explain the purposes of the disclosure and are not to be construed as limiting the disclosure in any way. Under the teaching of the disclosure, any possible changes based on the disclosure may be conceived by those skilled in the related art, which should be considered as falling within the scope of the disclosure. It should be noted that when an element is referred to as being "disposed on" the other element, it may be directly on the other element or there may also be an intermediate element. When an element is considered to be "connected" to the other element, it may be directly connected to another component the other element or there may be an intermediate element. The terms "mounted", "connected" and "connection" should be understood in a broad sense. For example, they can be mechanically or electrically connected, or internally connected between two elements, either directly or indirectly through an intermediate medium. For those skilled in the related art, the specific meaning of the above terms may be understood according to specific circumstances. The terms "vertical", "horizontal", "up", "down", "left", "right" and similar expressions used herein are for illustrative purposes only and are not intended to be exclusive embodiments.

Unless otherwise defined, all technical and scientific terms used herein have the same meanings as those commonly understood by those skilled in the related art of the disclosure. The terms used in the specification of the disclosure herein are only for the purpose of describing specific embodiments, and are not intended to be limiting of the disclosure. As used herein, the term "and/or" includes any and all combinations of one or more associated listed items.

The disclosure will be described in detail below with reference to the accompanying drawings and in combination with the embodiments.

As shown in FIG. 1, in order to achieve the above purposes, the technical solution employed by the disclosure to solve this problem is to provide a hydraulic oscillation tool with variable stage, small pressure drop and strong impact based on radio frequency identification. The hydraulic oscillation tool includes a conversion connector 1, an upper bracket 2 (also referred to as disc spring upper bracket), a disc spring housing 3, a disc spring group 4, a multi-stage piston shaft 5, an upper piston sleeve 6, a first radial sealing ring 7 (also referred to as a radical sealing ring B), a double-female-buckle piston sleeve 8 (also referred to as a piston sleeve with double female buckles), a double-male-buckle piston sleeve 9 (also referred to as a piston sleeve with double male buckles), a second radial sealing ring 10 (also referred to as radial sealing ring A), a double-female-buckle lower piston sleeve 11 (also referred to as a lower piston sleeve with double female buckles), an end piston 12, an impacting connector 13, a power shaft housing 14, a power shaft end cap 15, a high torque turbine 16, a power shaft 17, a lower connector 18, a rotating valve 19, a bearing-supporting ring 20, a turbine-fitting bearing 21, a first O-ring 22 (also referred to as O-ring A), a second O-ring 23 (also referred to as O-ring B), a third O-ring 24 (also referred to as O-ring C), and a fourth O-ring 25 (also referred to as O-ring D).

Figure 4:
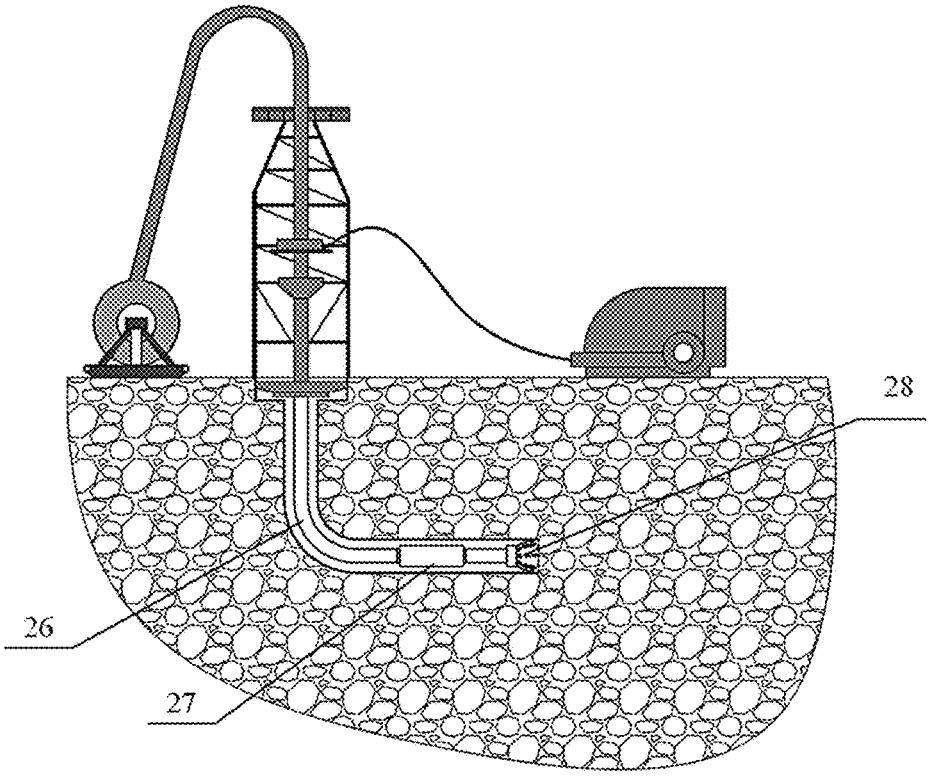
FIG. 4 is a schematic diagram of drilling in a short-distance horizontal section of the disclosure.

As shown in FIG. 1 and FIG. 4, the conversion connector 1 is connected to the multi-stage piston shaft 5 through tapered threads.

The disc spring housing 3 is connected to the upper bracket 2 and the upper piston sleeve 6 through tapered threads.

The disc spring group 4 is disposed between the disc spring housing 3 and the conversion connector 1.

The double-female-buckle piston sleeve 8 is connected to the upper piston sleeve 6 and the double-male-buckle piston sleeve 9 through tapered threads.

The double-female-buckle lower piston sleeve 11 is connected to the impacting connector 13 and the double-male-buckle piston sleeve 9 through tapered threads.

The end piston 12 is connected to the multi-stage piston shaft 5 through threads, and a first O-ring 22 is disposed between the end piston 12 and the impacting connector 13.

As shown in FIG. 1 and FIG. 4, a ground pressure pump pressurizes a wellbore, a drilling fluid drives the high torque turbine 16 passing through an inner cavity of the conversion connector 1 and an inner cavity of the multi-stage piston shaft 5. Under an action of the drilling fluid, the high torque turbine 16 drives the power shaft 17 to rotate, and in this situation, the rotating valve 19 connected to the power shaft 17 and an inner hole of the lower connector 18 realize relative rotary movement, thus realizing an alternation of drilling fluid flow areas. When the flow area decreases, a pressure in a cavity of the tool increases, when the flow area increases, the pressure in the cavity of the tool decreases, so that the pressure in the cavity of the tool increases and decreases alternately. When the pressure in the cavity increases, the drilling fluid acts on the end piston 12, under the action of the pressure of the drilling fluid, the multi-stage piston shaft 5 compresses the disc spring group 4 to convert the pressure of the drilling fluid into mechanical energy and then into elastic potential energy of the disc spring group 4. When the pressure in the cavity decreases, the elastic potential energy of the disc spring group 4 is released, and the elastic potential energy is converted into the mechanical energy, and the tool generates an impact.

Figure 2:
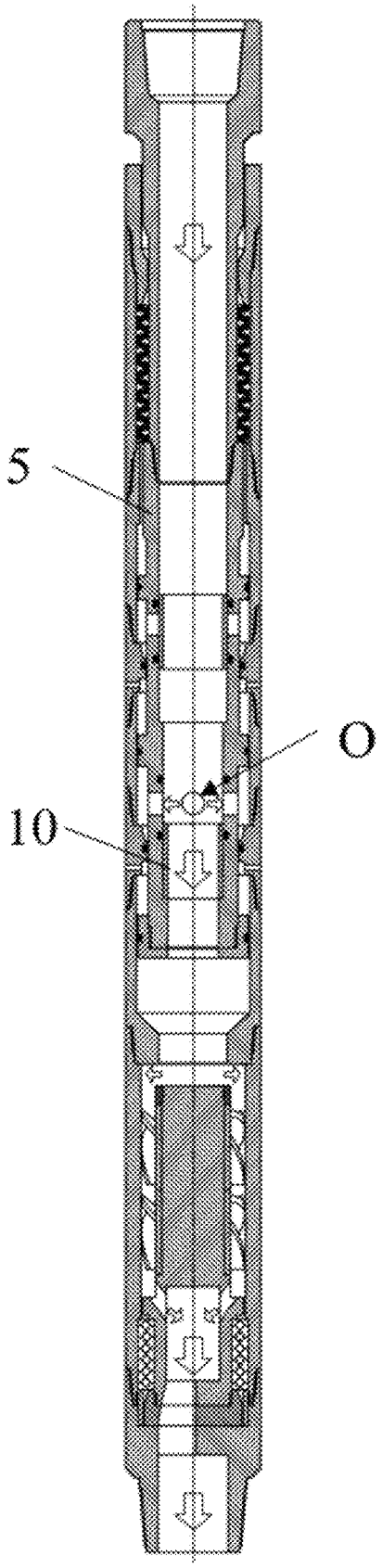
FIG. 2 is a schematic diagram of the hydraulic oscillation tool working in a two-stage pressure cavity of the disclosure.
Figure 5:
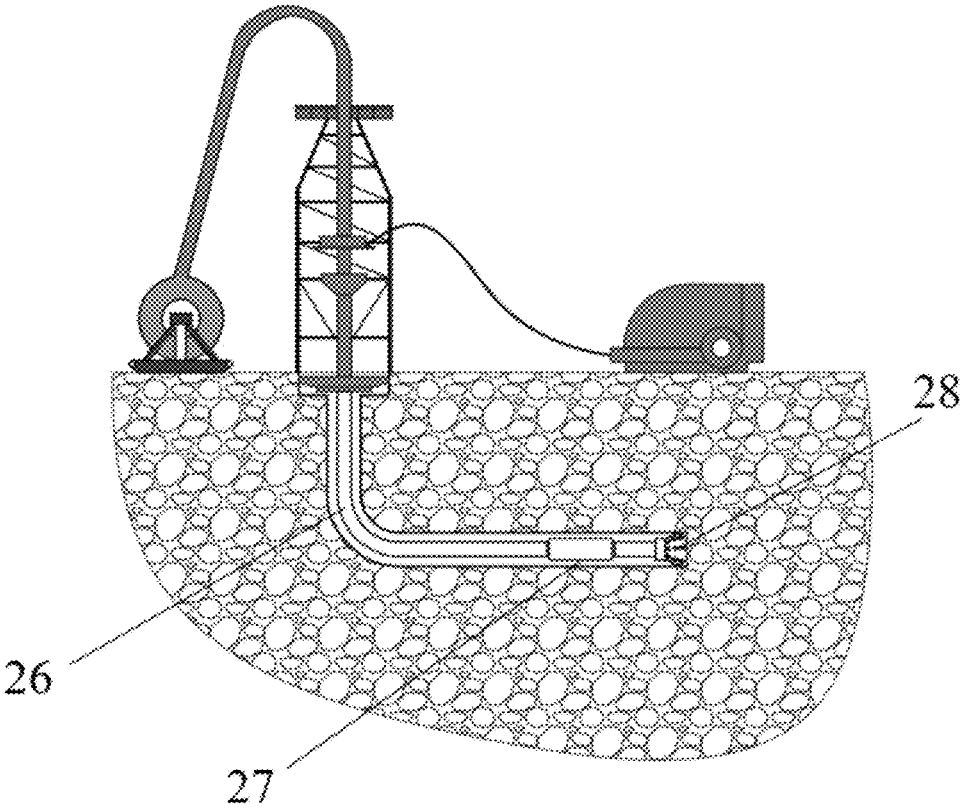
FIG. 5 is a schematic diagram of drilling in a middle-distance horizontal section of the disclosure.

As shown in FIG. 2 and FIG. 5, a soluble ball with a radio-frequency identification (RFID) tag is input and pumped into the tool. When the soluble ball passes through the second radial sealing ring 10, the second radial sealing ring 10 will move axially, in this situation, a first hole O on the multi-stage piston shaft 5 corresponding the second radial sealing ring 10 is opened, and the drilling fluid enters a cavity between the multi-stage piston shaft 5 and the double-male-buckle piston sleeve 9. In this way, the hydraulic oscillation tool can work in a two-stage pressure cavity, and the pressure action area is increased and the impact force of the tool is also increased.

Figure 3:
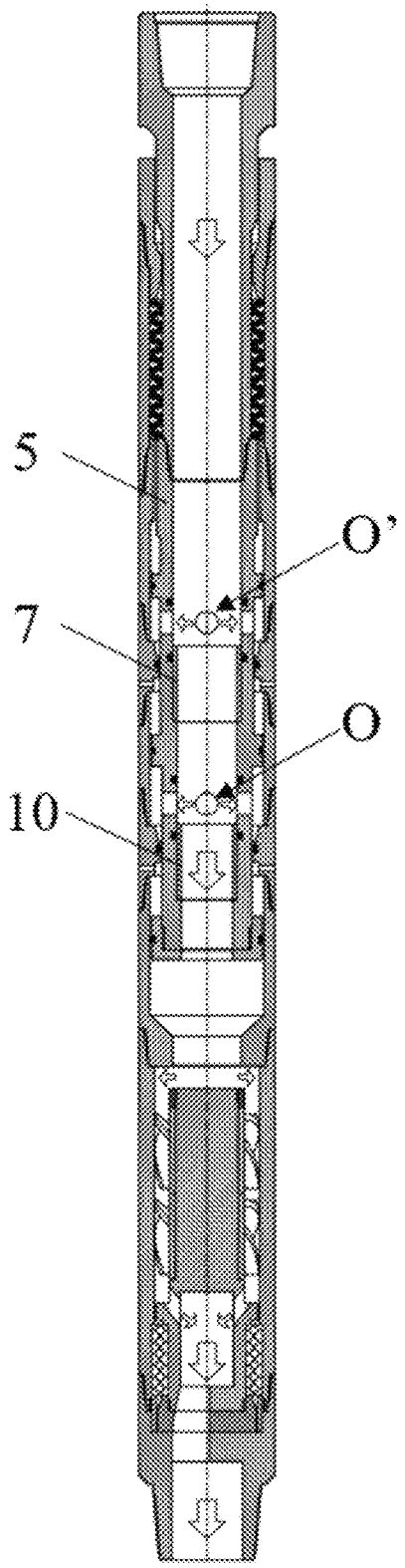
FIG. 3 is a schematic diagram of the hydraulic oscillation tool working in a three-stage pressure cavity of the disclosure.
Figure 6:
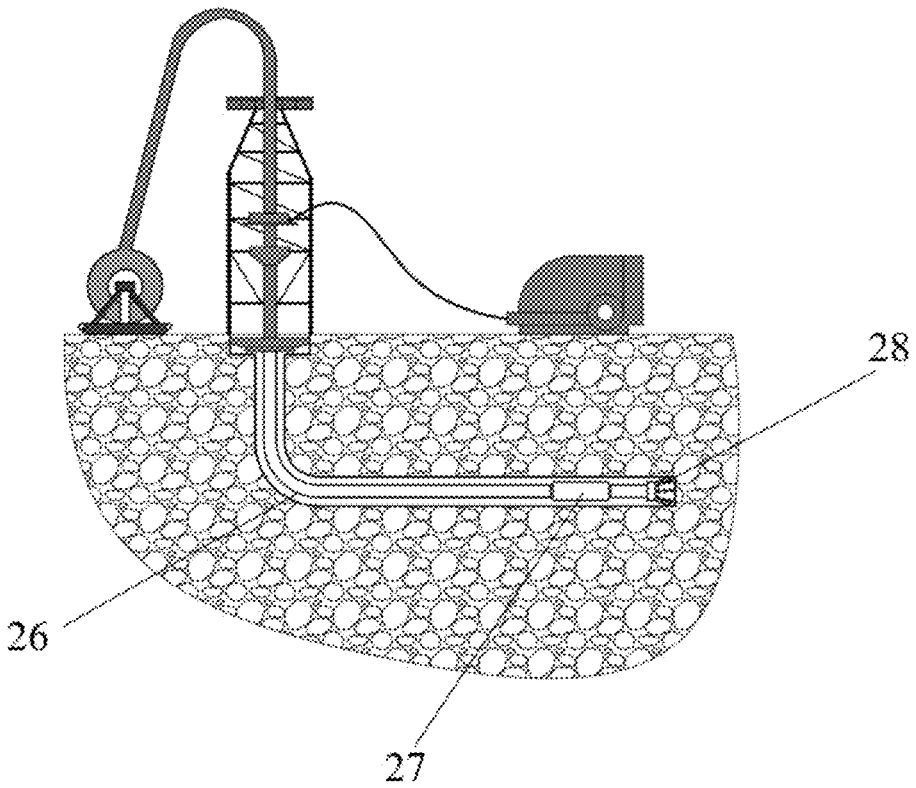
FIG. 6 is the schematic diagram of drilling in a long-distance horizontal of the disclosure.

As shown in FIG. 3 and FIG. 6, another soluble ball with another RFID tag is input and pumped into the tool, a second hole O' on the multi-stage piston shaft 5 corresponding to the first radial sealing ring 7 is opened, and the drilling fluid is entered therein. In this way, the hydraulic oscillation tool can work in a three-stage pressure cavity, and the pressure area and the impact force of the tool are further increased. The stages of the multi-stage piston shaft 5 can be variable to make the pressure area of the tool be variable, and thus improve the performance of the tool in service.

In some embodiments, the number of the high torque turbines 16 is generally in a range of 1 to 3, which are disposed in the same direction. The number of torque turbines 16 and the pressure of drilling fluid determines a rotational speed of the power shaft 17, thereby affecting the tool frequency.

In some embodiments, the number of stages of the multi-stage piston shaft 5 and the number of the first and the second radial sealing rings 7 and 8 are generally in a range of 2 to 4. The more stages, the same impact force can be achieved under the smaller pressure drop of the tool, especially for long horizontal sections.

In some embodiments, the third O-ring 24 is disposed among the second radial sealing ring 10, the first radial sealing ring 7 and the multi-stage piston shaft 5.

In some embodiments, when the soluble balls with the RFID tags are put into use, a pump pressure can be controlled to change without changing the impact force, or the pump pressure can be kept unchanged to enhance the impact force.

In some embodiments, the soluble balls with the RFID tags can be dissolved in place and flowback after radio frequency signal identification.

The above description is only preferred embodiments of the disclosure, and is not intended to limit the spirit and principle of the disclosure. Any modifications, equivalent replacements, improvements, etc. shall be included in the scope of the disclosure.

What is claimed is:

1. A hydraulic oscillation tool based on radio frequency identification, comprising:

a conversion connector, an upper bracket, a disc spring housing, a disc spring group, a multi-stage piston shaft, an upper piston sleeve, a first radial sealing ring, a double-female-buckle piston sleeve, a double-male-buckle piston sleeve, a second radial sealing ring, a double-female-buckle lower piston sleeve, an end piston, an impacting connector, a power housing, a power shaft end cap, a torque turbine, a power shaft, a lower connector, a rotating valve, a bearing-supporting ring, a turbine-fitting bearing, a first O-ring, a second O-ring, a third O-ring, a fourth O-ring;

wherein the conversion connector is connected to the multi-stage piston shaft through tapered threads; the disc spring housing is connected to the upper bracket and the upper piston sleeve through tapered threads; the disc spring group is disposed between the disc spring housing and the conversion connector; the double-female-buckle piston sleeve is connected to the upper piston sleeve and the double-male-buckle piston sleeve through tapered threads; the double-female-buckle lower piston sleeve is connected to the impacting connector and the double-male-buckle piston sleeve through tapered threads; the end piston is connected to the multi-stage piston shaft through threads, and the first O-ring is disposed between the end piston and the impacting connector;

wherein a drilling fluid drives the torque turbine passing through an inner cavity of the conversion connector and an inner cavity of the multi-stage piston shaft, the torque turbine drives the power shaft to rotate, while the rotating valve connected to the power shaft and an inner hole of the lower connector realize an area alternation to thereby make a pressure in a cavity of the tool increases and decreases alternately; when the pressure in the cavity of the tool increases, the drilling fluid acts on the end piston to drive the multi-stage piston shaft to compress the disc spring group; and when the pressure in the cavity of the tool decreases, elastic potential energy of the disc spring group is released, thereby causing impact; and wherein a soluble ball with a radio-frequency identification (RFID) tag is input and pumped to the tool, when the soluble ball with the RFID tag passes through the second radial sealing ring, the second radial sealing ring moves axially, to thereby make a first hole on the multi-stage piston shaft corresponding the second radial sealing ring be opened, a pressure action area be increased, and an impact force be increased; and another soluble ball with another RFID tag is input and pumped to the tool, to make a second hole on the multi-stage piston shaft corresponding to the first radial sealing ring be opened, to further increase the pressure action area.

2. The hydraulic oscillation tool according to claim 1, wherein a number of torque turbines is in a range of 1 to 3, and the torque turbines are disposed in a same direction.

3. The hydraulic oscillation tool according to claim 1, wherein a number of stages of the multi-stage piston shaft is in a range of 2 to 4, and a number of the first radial sealing ring and the second radial sealing ring is in a range of 2 to 4.

4. The hydraulic oscillation tool according to claim 1, wherein the third O-ring is disposed among the second radial sealing ring, the first radial sealing ring and the multi-stage piston shaft.

5. The hydraulic oscillation tool according to claim 1, wherein when the soluble balls with the RFID tags are put into use to make a pump pressure be controlled to change without changing the impact force or the pump pressure be kept unchanged to enhance the impact force.

6. The hydraulic oscillation tool according to claim 1, wherein the soluble balls with the RFID tags are dissolved in place and backflow after radio frequency signal identification.

7. The hydraulic oscillation tool according to claim 1, wherein the second radial sealing ring and the first radial sealing ring each are disposed with a RFID signal-receiving device.

* * * * *